US011562757B2

(12) United States Patent
Beack et al.

(10) Patent No.: US 11,562,757 B2
(45) Date of Patent: Jan. 24, 2023

(54) METHOD OF ENCODING AND DECODING AUDIO SIGNAL USING LINEAR PREDICTIVE CODING AND ENCODER AND DECODER PERFORMING THE METHOD

(71) Applicant: ELECTRONICS AND TELECOMMUNICATIONS RESEARCH INSTITUTE, Daejeon (KR)

(72) Inventors: Seung Kwon Beack, Daejeon (KR); Jongmo Sung, Daejeon (KR); Mi Suk Lee, Daejeon (KR); Tae Jin Lee, Daejeon (KR); Woo-taek Lim, Daejeon (KR); Inseon Jang, Daejeon (KR); Jin Soo Choi, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 0 days.

(21) Appl. No.: 17/377,157

(22) Filed: Jul. 15, 2021

(65) Prior Publication Data

US 2022/0020385 A1 Jan. 20, 2022

(30) Foreign Application Priority Data

Jul. 16, 2020 (KR) ..... 10-2020-0087902

(51) Int. Cl.
*G10L 19/06* (2013.01)
*G10L 19/032* (2013.01)

(52) U.S. Cl.
CPC ..... *G10L 19/06* (2013.01); *G10L 19/032* (2013.01)

(58) Field of Classification Search
None
See application file for complete search history.

(56) References Cited

U.S. PATENT DOCUMENTS 5,206,884 A * 4/1993 Bhaskar ..... G10L 19/08 704/229
7,672,838 B1 3/2010 Athineos et al.
(Continued)

OTHER PUBLICATIONS

Max Neuendorf et al., "MPEG Unified Speech and Audio Coding—The ISO/MPEG Standard for High-Efficiency Audio Coding of all Content Types," Presented at the 132nd Convention of Audio Engineering Society, Apr. 26-29, 2012 , pp. 1-22, Budapest, Hungary.

*Primary Examiner* — Shaun Roberts

(57) ABSTRACT

An audio signal encoding method performed by an encoder includes identifying a time-domain audio signal in a unit of blocks, quantizing a linear prediction coefficient extracted from a combined block in which a current original block of the audio signal and a previous original block chronologically adjacent to the current original block using frequency-domain linear predictive coding (LPC), generating a temporal envelope by dequantizing the quantized linear prediction coefficient, extracting a residual signal from the combined block based on the temporal envelope, quantizing the residual signal by one of time-domain quantization and frequency-domain quantization, and transforming the quantized residual signal and the quantized linear prediction coefficient into a bitstream.

14 Claims, 8 Drawing Sheets

(56) References Cited

U.S. PATENT DOCUMENTS

| | | | | |
|---|---|---|---|---|
| 8,428,957 | B2 | 4/2013 | Garudadri et al. | |
| 9,711,159 | B2 | 7/2017 | Lee et al. | |
| 2006/0171542 | A1* | 8/2006 | Den Brinker | G10L 19/008 381/23 |
| 2006/0277040 | A1* | 12/2006 | Sung | G10L 19/24 704/E19.044 |
| 2007/0124136 | A1* | 5/2007 | Den Brinker | G10L 21/038 704/E21.011 |
| 2008/0172223 | A1* | 7/2008 | Oh | G10L 19/20 704/E19.01 |
| 2011/0087494 | A1* | 4/2011 | Kim | G10L 19/0212 704/500 |
| 2012/0039414 | A1* | 2/2012 | Fang | G10L 19/005 375/295 |
| 2013/0132100 | A1 | 5/2013 | Sung et al. | |
| 2016/0093311 | A1* | 3/2016 | Kim | H04S 3/008 381/22 |

* cited by examiner

METHOD OF ENCODING AND DECODING AUDIO SIGNAL USING LINEAR PREDICTIVE CODING AND ENCODER AND DECODER PERFORMING THE METHOD

CROSS-REFERENCE TO RELATED APPLICATION(S)

This application claims the priority benefit of Korean Patent Application No. 10-2020-0087902 filed on Jul. 16, 2020, in the Korean Intellectual Property Office, the disclosure of which is incorporated herein by reference for all purposes.

BACKGROUND

1. Field

One or more example embodiments relate to a method of encoding and decoding an audio signal and an encoder and a decoder performing the method, and more particularly, to a technology for estimating time-domain information in a frequency domain in a process of encoding an audio signal using linear predictive coding (LPC), thereby reducing a distortion that may occur in the process of encoding.

2. Description of Related Art

Unified speech and audio coding (USAC) is a fourth-generation audio coding technology that is developed to improve the quality of a low-bit-rate sound that has not been covered before by the Moving Picture Experts Group (MPEG). USAC is currently being used as the latest audio coding technology that provides a high-quality sound for speech and music.

To encode an audio signal through USAC or other audio coding technologies, a linear predictive coding (LPC)-based quantization process may be employed. LPC refers to a technology for encoding an audio signal by encoding a residual signal corresponding to a difference between a current sample and a previous sample among audio samples that constitute the audio signal.

However, an existing frequency-domain-based audio coding technology may not effectively cover time-domain information, and thus a distortion may occur in a time domain of a decoded audio signal. Thus, there is a desire for a technology for reducing such a distortion of time-domain information and increasing encoding efficiency.

SUMMARY

An aspect provides a method of reducing a distortion that may occur in a time domain when encoding and decoding an audio signal using linear predictive coding (LPC), and an encoder and a decoder performing the method.

According to an example embodiment, there is provided a method of encoding an audio signal performed by an encoder, the method including identifying a time-domain audio signal in a unit of blocks, quantizing a linear prediction coefficient extracted from a combined block in which a current original block of the audio signal and a previous original block to chronologically adjacent to the current original block are combined using frequency-domain LPC, generating a temporal envelope by dequantizing the quantized linear prediction coefficient, extracting a residual signal from the combined block based on the temporal envelope, quantizing the residual signal through one of time-domain quantization and frequency-domain quantization, and transforming the quantized residual signal and the quantized linear prediction coefficient into a bitstream.

The quantizing the residual signal may include comparing noise generated by the time-domain quantization and noise generated by the frequency-domain quantization, and quantizing the residual signal by quantization with less noise.

The quantizing the residual signal may include comparing a signal-to-noise ratio (SNR) obtained as a result of quantizing the residual signal by the time-domain quantization and an SNR obtained as a result of quantizing the residual signal by the frequency-domain quantization, and quantizing the residual signal by quantization with a greater SNR.

The quantizing the residual signal may include quantizing the residual signal by transforming the residual signal into a frequency domain to quantize the residual signal through the frequency-domain quantization.

The method may further include generating the combined block by combining the current original block of the audio signal and the previous original block chronologically adjacent to the current original block, and transforming the combined block and a combined block obtained through a Hilbert transform into the frequency domain and extracting linear prediction coefficients corresponding to the combined block and the Hilbert-transformed combined block by LPC.

The extracting the residual signal may include generating an interpolated current envelope from the temporal envelope using symmetric windowing, and extracting a time-domain residual signal from the combined block based on the current envelope.

According to another example embodiment, there is provided a method of decoding an audio signal performed by a decoder, the method including extracting a quantized linear prediction coefficient and a quantized residual signal from a bitstream received from an encoder, generating a temporal envelope by dequantizing the quantized linear prediction coefficient, and reconstructing an audio signal from the quantized residual signal using the temporal envelope.

When the quantized residual signal is quantized in a frequency domain, the method may further include dequantizing the quantized residual signal and transforming the dequantized residual signal into a time domain.

The generating the temporal envelope may include generating a current envelope by combining temporal envelopes based on LPC coefficients corresponding to the same time from between two chronologically adjacent dequantized LPC coefficients. The reconstructing the audio signal may include dequantizing the quantized residual signal, and generating the audio signal from the dequantized residual signal using the current envelope.

When the residual signal included in the bitstream is quantized in the frequency domain, the method may further include adjusting noise of the audio signal by overlapping reconstructed audio signals.

According to still another example embodiment, there is provided an encoder configured to perform a method of encoding an audio signal, the encoder including a processor. The processor may identify a time-domain audio signal in a unit of blocks, quantize a linear prediction coefficient extracted from a combined block in which a current original block of the audio signal and a previous original block chronologically adjacent to the current original block are combined using frequency-domain LPC, generate a temporal envelope by dequantizing the quantized linear prediction coefficient, extract a residual signal from the combined block based on the temporal envelope, quantize the residual signal using one of time-domain quantization and frequency-domain quantization, and transform the quantized residual signal and the quantized linear prediction coefficient into a bitstream.

The processor may compare noise generated by the time-domain quantization and noise generated by the frequency-domain quantization, and quantize the residual signal by quantization with less noise.

The processor may compare an SNR obtained as a result of quantizing the residual signal by the time-domain quantization and an SNR obtained as a result of quantizing the residual signal by the frequency-domain quantization, and quantize the residual signal by quantization with a greater SNR.

When the residual signal is quantized in a frequency domain, the processor may quantize the residual signal by transforming the residual signal into the frequency domain.

The processor may generate the combined signal by combining the current original block of the audio signal and the previous original block chronologically adjacent to the current original block, and transform the combined block and a combined block obtained through a Hilbert transform into the frequency domain and extract linear prediction coefficients corresponding to the combined block and the Hilbert-transformed combined block by LPC.

The processor may generate an interpolated current envelope from the temporal envelope using symmetric windowing, and extract a time-domain residual signal from the combined block based on the current envelope.

According to yet another example embodiment, there is provided a decoder configured to perform a method of decoding an audio signal, the decoder including a processor. The processor may extract a quantized linear prediction coefficient and a quantized residual signal from a bitstream received from an encoder, generate a temporal envelope by dequantizing the quantized linear prediction coefficient, and reconstruct an audio signal from the quantized residual signal using the temporal envelope.

When the quantized residual signal is quantized in a frequency domain, the processor may dequantize the quantized residual signal and transform the dequantized residual signal into a time domain.

The processor may generate a current envelope by combining temporal envelopes based on LPC coefficients corresponding to the same time from between two chronologically adjacent dequantized LPC coefficients, dequantize the quantized residual signal, and generate the audio signal from the dequantized residual signal using the current envelope.

When the residual signal included in the bitstream is quantized in the frequency domain, the processor may adjust noise of the audio signal by overlapping reconstructed audio signals.

According to example embodiments described herein, it is possible to reduce a distortion that may occur in a time domain when encoding and decoding an audio signal using LPC.

Additional aspects of example embodiments will be set forth in part in the description which follows and, in part, will be apparent from the description, or may be learned by practice of the disclosure.

BRIEF DESCRIPTION OF THE DRAWINGS

These and/or other aspects, features, and advantages of the present disclosure will become apparent and more readily appreciated from the following description of example embodiments, taken in conjunction with the accompanying drawings of which.

DETAILED DESCRIPTION

Figure 1:
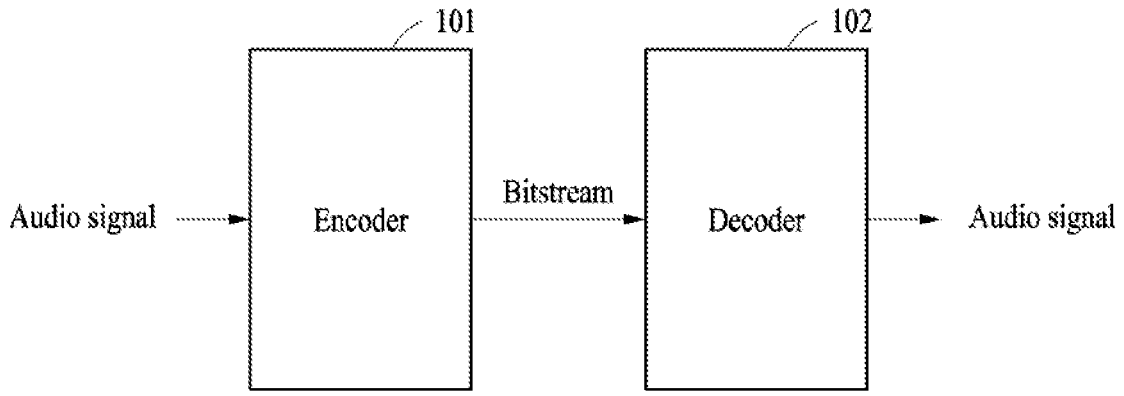
FIG. 1 is a diagram illustrating an example of an encoder and an example of a decoder according to an example embodiment.

Hereinafter, example embodiments will be described in detail with reference to the accompanying drawings. However, various alterations and modifications may be made to the examples. Here, the examples are not construed as limited to the disclosure and should be understood to include all changes, equivalents, and replacements within the idea and the technical scope of the disclosure.

The terminology used herein is for the purpose of describing particular examples only and is not to be limiting of the examples. As used herein, the singular forms "a," "an," and "the" are intended to include the plural forms as well, unless the context clearly indicates otherwise. It will be further understood that the terms "comprises/comprising" and/or "includes/including" when used herein, specify the presence of stated features, integers, steps, operations, elements, and/or components, but do not preclude the presence or addition of one or more other features, integers, steps, operations, elements, components and/or groups thereof.

Unless otherwise defined, all terms, including technical and scientific terms, used herein have the same meaning as commonly understood by one of ordinary skill in the art to which this disclosure pertains consistent with and after an understanding of the present disclosure. Terms, such as those defined in commonly used dictionaries, are to be interpreted as having a meaning that is consistent with their meaning in the context of the relevant art and the present disclosure, and are not to be interpreted in an idealized or overly formal sense unless expressly so defined herein.

In the description of example embodiments, detailed description of structures or functions that are thereby known after an understanding of the disclosure of the present application will be omitted when it is deemed that such description will cause ambiguous interpretation of the example embodiments.

In addition, terms such as first, second, A, B, (a), (b), and the like may be used herein to describe components. Each of these terminologies is not used to define an essence, order, or sequence of a corresponding component but used merely to distinguish the corresponding component from other component(s). Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween. Likewise, expressions, for example, "between" and "immediately between" and "adjacent to" and "immediately adjacent to" may also be construed as described in the foregoing.

Hereinafter, example embodiments will be described in detail with reference to the accompanying drawings. Regarding the reference numerals assigned to the elements in the drawings, it should be noted that the same elements will be designated by the same reference numerals, wherever possible, even though they are shown in different drawings.

FIG. 1 is a diagram illustrating an example of an encoder and an example of a decoder according to an example embodiment.

In a process of encoding an audio signal, the encoding may be performed by performing linear predictive coding (LPC) to reduce a distortion of a sound quality, and by quantizing a residual signal doubly extracted from the audio signal.

For example, a residual signal may be generated based on a temporal envelop generated using frequency-domain LPC to reduce a distortion that may occur in a time domain and increase encoding efficiency. An envelope used herein refers to a curve having a shape that surrounds a waveform of a residual signal. A temporal envelope used herein indicates a rough outline of a residual signal in the time domain.

According to an example embodiment, an encoder and a decoder respectively performing an encoding method and a decoding method described herein may be processors. The encoder and the decoder may be the same processor or different processors.

Referring to FIG. 1, an encoder 101 may process an audio signal and transform the processed audio signal into a bitstream, and transmit the bitstream to a decoder 102. The decoder 102 may reconstruct an audio signal using the received bitstream.

The encoder 101 and the decoder 102 may process the audio signal in a unit of blocks. An audio signal described herein may include a plurality of audio samples in the time domain, and an original block of the audio signal may include a plurality of audio samples corresponding to a predetermined time interval. The audio signal may include a plurality of sequential original blocks. An original block of the audio signal may correspond to a frame of the audio signal.

According to an example embodiment, a combined block in which chronologically adjacent original blocks are combined may be encoded. For example, the combined block may include two original blocks that are adjacent to each other in chronological order. For example, when a combined block at a certain time point includes a current original block and a previous original block, a combined block corresponding to a subsequent time point may include, as a previous original block, the current original block included in the combined block at the time point.

A detailed process of encoding a generated combined block will be described hereinafter with reference to FIG. 2.

Figure 2:
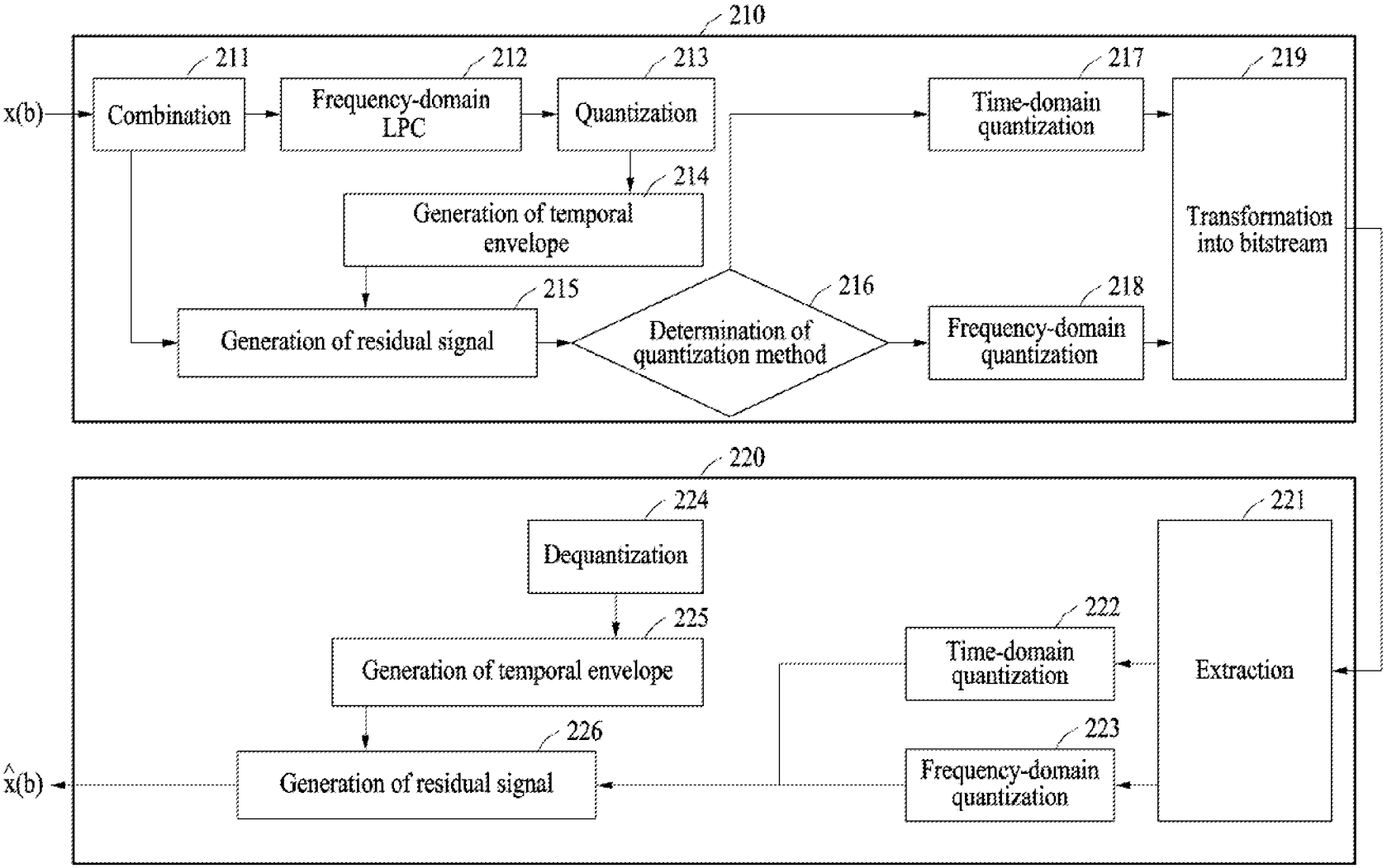
FIG. 2 is a diagram illustrating an example of operations of an encoder and a decoder according to an example embodiment.

FIG. 2 is a diagram illustrating an example of operations of an encoder and a decoder according to an example embodiment.

Referring to FIG. 2, x(b) indicates an original block of an audio signal, in which b denotes an index of the original block. For example, an index of an original block may be determined to increase with time. x(b) may include N audio samples. In operation 211 for combination, an encoder 210 may generate a combined block by combining chronologically adjacent original blocks.

For example, when x(b) is a current original block and x(b−1) is a previous original block, the encoder 210 may generate a combined block by combining the current original block and the previous original block in operation 211. In this example, the current original block and the previous original block may be adjacent to each other in chronological order, and the current original block may be an original block at a predetermined time point. The combined block, for example, X(b), may be represented by Equation 1 below.

$$X(b)=[x(b-1),x(b)]^T \quad \text{[Equation 1]}$$

The combined block may be generated at an interval corresponding to one original block. For example, a bth combined block X(b) may include a bth original block x(b) and a b−1th original block x(b−1). In this example, a b−1th combined block X(b−1) may include the b−1th original block x(b−1) and a b−2th original block x(b−2).

When generating a combined block by receiving a chronologically sequential audio signal, the encoder 210 may use a buffer to use a current original block of a combined block at a predetermined time point as a previous original block of a combined block at a subsequent time point.

In operation 212 for frequency-domain LPC, the encoder 210 may extract a frequency-domain linear prediction coefficient from the combined block using frequency-domain LPC.

For example, in operation 212 for frequency-domain LPC, the encoder 210 may transform the combined block and a combined block obtained through a Hilbert transform into a frequency domain. The encoder 210 may then extract a time-domain linear prediction coefficient corresponding to the combined block and the Hilbert-transformed combined block using LPC.

The frequency-domain LPC will be described in detail with reference to FIG. 3.

In operation 213 for quantization, the encoder 210 may quantize the frequency-domain linear prediction coefficient. In operation 219 for transformation into a bitstream, the encoder 210 may transform the quantized frequency-domain linear prediction coefficient into a bitstream and transmit the bitstream to a decoder 220. A method of quantizing a linear prediction coefficient is not limited to the foregoing example, and various methods may be used.

In operation 214 for generation of a temporal envelope, the encoder 210 may dequantize the quantized linear prediction coefficient and use the dequantized linear prediction coefficient to generate a temporal envelope. For example, the encoder 210 may dequantize the quantized linear prediction coefficient, transform the linear prediction coefficient into the time domain, and generate the temporal envelop based on the frequency-domain linear prediction coefficient that is transformed into the time domain, as represented by Equation 2 below.

$$env(b) = \frac{1}{N} \times 10 \times \log10\left[\text{abs}(IDFT\{lpc_{c,f}(b), 2N\})^2\right] \quad \text{[Equation 2]}$$

In Equation 2, env(b) denotes a value of a temporal envelope corresponding to a bth combined block in a temporal envelope of a combined block. env(b) may have envelope information of the time domain of X(b), and have envelope information (en(b), en(b−1)) of x(b−1) and x(b). N denotes the number of audio samples included in an original block.

abs( ) denotes a function that outputs an absolute value of an input value. $lpc_{c,f}(b)$ denotes a complex value of a linear prediction coefficient corresponding to the bth combined block among linear prediction coefficients. IDFT{$lpc_{c,f}(b)$, 2N} denotes a function that outputs a result of performing a 2N-point inverse discrete Fourier transform (IDFT) on $lpc_{c,f}(b)$.

In operation 215 for generation of a residual signal, the encoder 210 may extract a time-domain residual signal from the combined block based on the temporal envelope. To extract the residual signal, the encoder 210 may generate an interpolated current envelope from the temporal envelope using symmetric windowing.

A detailed operation of generating a current envelope will be described hereinafter with reference to FIG. 4. The encoder 210 may extract the time-domain residual signal from the combined block using the current envelope, as represented by Equations 3 through 5 below.

$$\text{abs}(\text{res}(b))=10\log 10(\text{abs}(X(b))^2)-\text{cur_en}(b) \quad \text{[Equation 3]}$$

$$\text{angle}(\text{res}(b))=\text{angle}(X(b)) \quad \text{[Equation 4]}$$

$$\text{res}(b)=\text{abs}(\text{res}(b))\exp(j\times\text{angle}(\text{res}(b))) \quad \text{[Equation 5]}$$

In Equation 3 above, b denotes an index of a current combined block. cur_en(b) denotes a current envelope corresponding to a current original block. X(b) denotes a first residual signal corresponding to a bth combined block. res(b) denotes a residual signal corresponding to the bth combined block. In Equation 3, the encoder 210 may obtain an absolute value of the residual signal by determining an absolute value of the combined block and calculating a difference between the determined absolute value and the current envelope.

In Equation 4 above, angle( ) denotes an angle function that returns a phase angle with respect to an input value. That is, the encoder 210 may calculate a phase angle of the residual signal from a phase angle of the combined block.

The encoder 210 may determine a second residual signal from the phase angle of the residual signal calculated based on Equation 5 and the absolute value of the residual signal. For example, the encoder 210 may determine the residual signal by multiplying an output value of an exponential function exp( ) with respect to the phase angle of the residual signal and the absolute value of the residual signal. j denotes a variable that indicates a complex number.

Also, since the residual signal corresponds to the combined block, the residual signal may correspond to the two chronologically adjacent original blocks. For example, a residual signal ($[\text{res}(b-1), \text{res}(b)]^T$) to be quantized may include a residual signal res(b−1) corresponding to a b−1th original block and a second residual signal res(b) corresponding to a bth original block. The encoder 210 may reduce a difference in quantization noise that may occur between the original blocks by performing an overlap-add (OLA) operation on the original blocks overlapping between the residual signals, thereby reducing a sound quality distortion.

In operation 216 for determination of a quantization method, the encoder 210 may quantize the residual signal based on one of time-domain quantization and frequency-domain quantization. For example, to select quantization having less noise, the encoder 210 may compare noise generated by the time-domain quantization and noise generated by the frequency-domain quantization. The encoder 210 may then quantize the residual signal by the quantization with less noise.

For example, the encoder 210 may compare a signal-to-noise ratio (SNR) obtained as a result of quantizing the residual signal through the time-domain quantization and an SNR obtained as a result of quantizing the residual signal through the frequency-domain quantization, and quantize the residual signal through a quantization method with a greater SNR.

When the SNR obtained as the result of the time-domain quantization is greater than the SNR obtained as the result of the frequency-domain quantization, the encoder 210 may perform quantization without overlapping the residual signals. Here, a method of quantizing a residual signal in the time domain is not limited to the foregoing example, and various methods may be used.

In contrast, when the SNR obtained as the result of the time-domain quantization is less than the SNR obtained as the result of the frequency-domain quantization, the encoder 210 may perform a transformation into the frequency domain. For example, the encoder 210 may transform the residual signal into the frequency domain using 2N-point discrete Fourier transform (DFT). The encoder 210 may quantize the residual signal transformed into the frequency domain.

For another example, when transforming the residual signal into the frequency domain using a modified discrete cosine transform (MDCT), the encoder 210 may quantize only a predetermined number of residual signals. Here, a method of quantizing a residual signal in the frequency domain is not limited to the foregoing example, and various methods may be used.

The decoder 220 may receive a bitstream from the encoder 210. In operation 221 for extraction, the decoder 220 may extract a quantized frequency-domain linear prediction coefficient and a quantized residual signal from the bitstream received from the encoder 210. In operation 221 for extraction, a generally used decoding method may be used, but examples of which are not limited to a specific one.

The decoder 220 may selectively perform dequantization based on whether the residual signal included in the bitstream is quantized in the time domain or in the frequency domain.

When the residual signal included in the bitstream is quantized in the time domain, operation 222 for time-domain quantization may be performed, and operation 223 for frequency-domain quantization may not be performed. In operation 222 for time-domain quantization, the decoder 220 may dequantize the quantized residual signal.

In contrast, when the residual signal included in the bitstream is quantized in the frequency domain, operation 223 for frequency-domain quantization may be performed, and operation 222 for time-domain quantization may not be performed. In operation 223 for frequency-domain quantization, the decoder 220 may dequantize the quantized residual signal. The decoder 220 may transform the dequantized residual signal into the time domain. For example, the decoder 220 may transform the residual signal into the time domain using i-DFT or IMDCT.

In addition, in operation 226 for generation of a residual signal, the decoder 220 may reconstruct an audio signal from the dequantized residual signal using a temporal envelope. The temporal envelope may be generated through operation 224 for dequantization and operation 225 for generation of a temporal envelope.

For example, in operation 224 for dequantization, the decoder 220 may dequantize the quantized frequency-domain linear prediction coefficient. The dequantization of the linear prediction coefficient may be an inverse process of the quantization and is not limited to a specific example. For example, a general method of quantizing a linear prediction coefficient may be used.

In operation 225 for generation of a temporal envelope, the decoder 220 may generate the temporal envelope from the frequency-domain linear prediction coefficient. The decoder 220 may transform the linear prediction coefficient into the time domain, and generate the temporal envelope based on the frequency-domain linear prediction coefficient transformed into the time domain. For example, the decoder 220 may generate the temporal envelope from the linear prediction coefficient using Equation 2.

In operation 226 for generation of a residual signal, the decoder 220 may reconstruct the audio signal from a reconstructed residual signal using the temporal envelope. For example, the decoder 220 may reconstruct the audio signal based on Equations 6 through 8.

$$\mathrm{abs}(\hat{x}(b))=10\log 10(\mathrm{abs}(\hat{\mathbf{FBS}}(b))^2)+\mathrm{cur_en}(b) \quad \text{[Equation 6]}$$

$$\mathrm{angle}(\hat{x}(b)))=\mathrm{angle}(\hat{\mathbf{FBS}}(b)) \quad \text{[Equation 7]}$$

$$\hat{x}(b)=\mathrm{abs}(\hat{x}(b))\exp(j\times\mathrm{angle}(\hat{x}(b))) \quad \text{[Equation 8]}$$

In Equations 6 through 8, abs( ) denotes a function that outputs an absolute value of an input value. $\hat{x}$(b) denotes a reconstructed bth original block, and cur_en(b) denotes a current envelope. angle( ) denotes a function that outputs a phase angle with respect to the input value. exp( ) denotes an exponential function, and j denotes a variable that indicates a complex number.

That is, the decoder 220 may determine an absolute value of the reconstructed residual signal based on Equation 6 above and calculate a sum of the determined absolute value and the current envelope to obtain an absolute value of the reconstructed original block. The decoder 220 may then determine a phase angle of the reconstructed residual signal based on Equation 7 above and obtain a phase angle of the original block from the determined phase angle.

The decoder 220 may reconstruct the original block from the phase angle of the original block and the absolute value of the original, based on Equation 8 above. In addition, when the residual signal included in the bitstream is quantized in the frequency domain, the decoder 220 may adjust noise of the audio signal by overlapping reconstructed audio signals using an OLA operation on the reconstructed original blocks.

Figure 3:
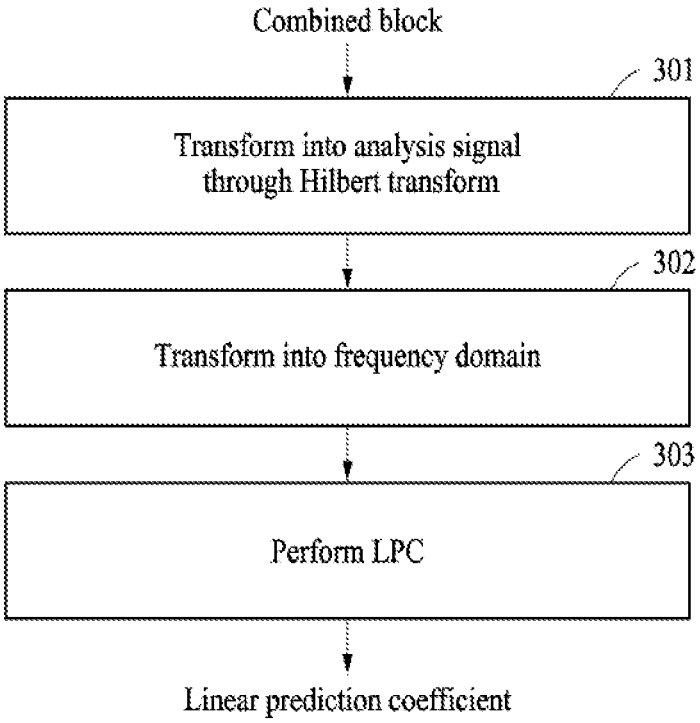
FIG. 3 is a flowchart illustrating an example of frequency-domain linear predictive coding (LPC) according to an example embodiment.

FIG. 3 is a flowchart illustrating an example of frequency-domain LPC according to an example embodiment.

In operation 301, an encoder may transform a combined block into an analysis signal using a Hilbert transform. The analysis signal may be defined by Equation 9 below.

$$X_c(b)=X(b)+jHT\{X(b)\} \quad \text{[Equation 9]}$$

In Equation 9, X(b) denotes a combined block, HT{ } denotes a function for performing a Hilbert transform, and j denotes an arbitrary variable that indicates a complex number. $X_c$(b) denotes an analysis signal. The analysis signal $X_c$(b) may indicate the combined block X(b) and a Hilbert-transformed combined block HT{X(b)} which is a combined block obtained through the Hilbert transform.

In operation 302, the encoder may transform the analysis signal into a frequency domain. For example, the encoder may transform the analysis signal into the frequency domain using a DFT. In operation 303, the encoder may determine a frequency-domain linear prediction coefficient from the analysis signal transformed into the frequency domain by using LPC. For example, the encoder may determine the linear prediction coefficient based on Equations 10 and 11 below.

$$err_c(k) = x_{c,f}(k) + \sum_{p=0}^{p} lpc_c(p)x_{c,f}(k-p) \quad \text{[Equation 10]}$$

$$err(k) = \mathrm{real}\{x_{c,f}(k)\} + \sum_{p=0}^{p} lpc(p)\cdot\mathrm{real}\{x_{c,f}(k-p)\} \quad \text{[Equation 11]}$$

In Equations 10 and 11, err denotes an error, p denotes the number of linear prediction coefficients, $\mathrm{lpc}_c$( ) denotes a linear prediction coefficient in the frequency domain or a frequency-domain linear prediction coefficient as described herein, and c denotes a variable that indicates a complex number. Since a value in Equation 10 is calculated in the form of a complex number, it is possible to extract a frequency-domain linear prediction coefficient as a real value according to Equation 11.

In Equation 11, real{ } denotes a function that outputs a result of extracting a real value from an input value. k denotes a frequency bin index, and N denotes a maximum range of a frequency bin.

The encoder may reduce an amount of data to be encoded by determining a time-domain linear prediction coefficient based on Equation 11 above. However, when an audio signal is encoded according to Equation 11, a temporal envelope may not be accurately predicted, and thus the encoder may generate a temporal envelope using a frequency-domain linear prediction coefficient and extract a residual signal to prevent a false signal phenomenon that may occur in the time domain. In addition, a decoder may remove time domain aliasing (TDA) using an OLA operation on a reconstructed combined block.

Figure 4:
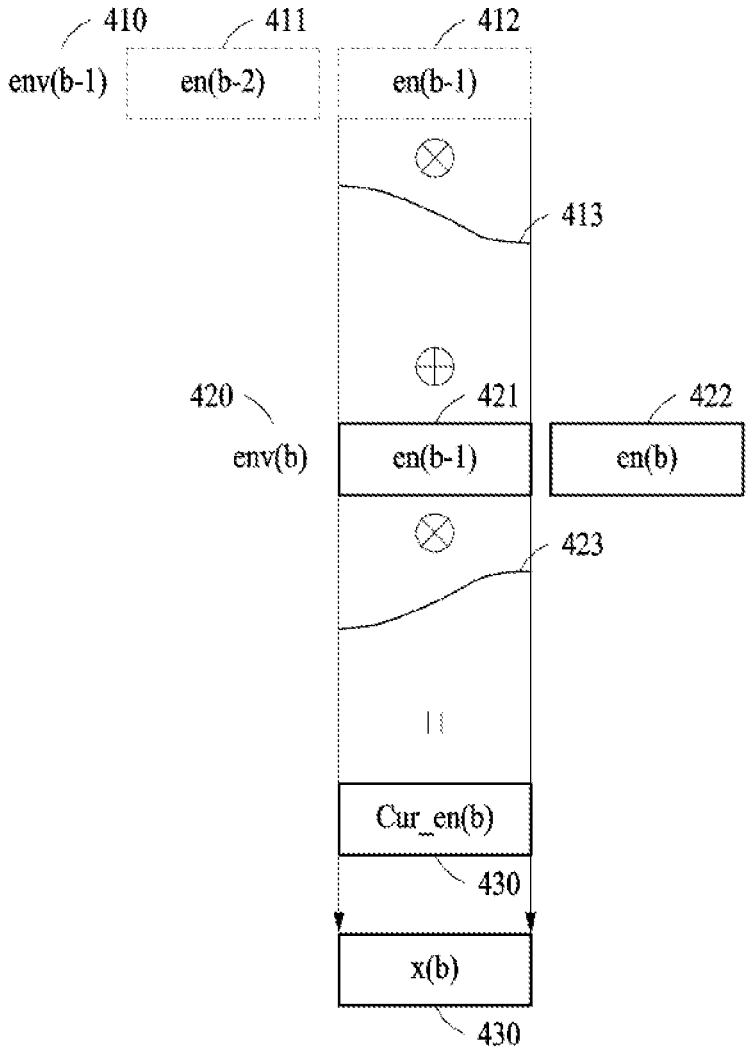
FIG. 4 is a diagram illustrating an example of combining time envelopes according to an example embodiment.

FIG. 4 is a diagram illustrating an example of combining time envelopes according to an example embodiment.

In a process of generating a residual signal, an encoder may extract a time-domain residual signal from an overlapping first residual signal based on a temporal envelope. For example, the encoder may first generate an interpolated current envelope 430 from temporal envelopes 410 and 420 using a symmetric window.

The temporal envelope 420 may be generated in association with an original block included in a combined block. When there are a value 421 of a temporal envelope 423 corresponding to a b−1th original block and a value 422 of a temporal envelope corresponding to a bth original block, the encoder may generate the current envelope 430 by combining a result 413 from the symmetry of values of a temporal envelope corresponding to an original block using the symmetric window and the value 421 of the temporal envelope 423 before the symmetry.

According to another example embodiment, the encoder may generate the current envelope 430 by moving by an interval corresponding to one original block 412 and combining the moved temporal envelope 410 and the temporal envelope 420 that is before the movement. A current envelope may be generated to smooth a temporal envelope, and thereby allow an unstable processing process for an interval in which an audio signal changes rapidly to be corrected.

Figure 5A:
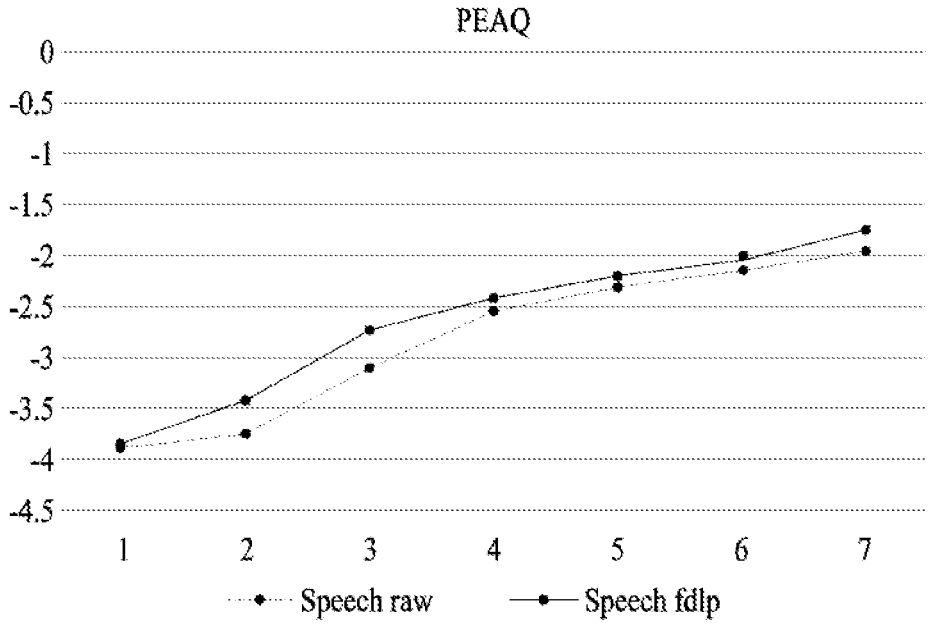
FIGS. 5A and 5B are graphs of experimental results according to an example embodiment.
Figure 5B:
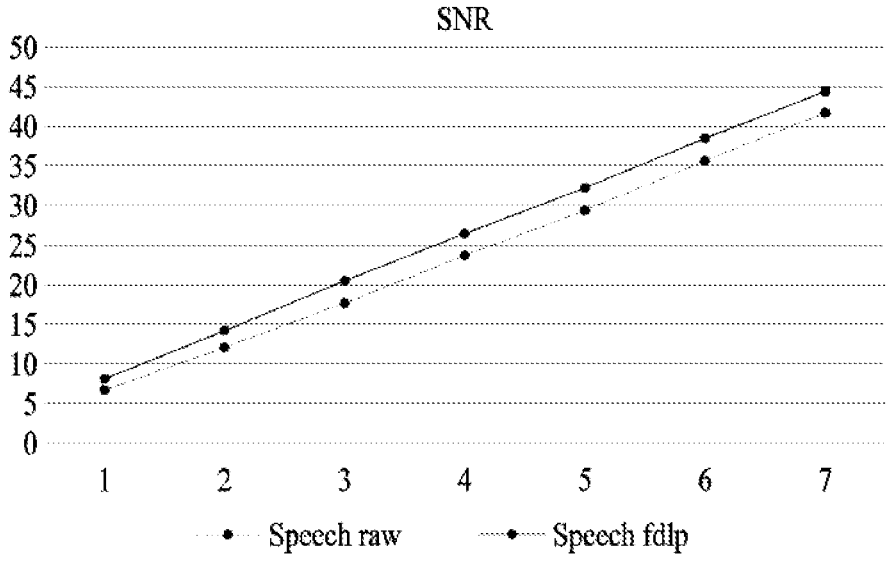

FIGS. 5A and 5B are graphs of experimental results according to an example embodiment.

The present disclosure provides a method of estimating a time-domain envelope, thereby increasing encoding efficiency. FIGS. 5A and 5B are diagrams illustrating experimental results obtained by objectively comparing encoding and decoding results obtained when the provided method is applied and when the provided method is not applied.

A perceptual evaluation of audio quality (PEAR) and an SNR are measured as objective indicators. Referring to FIGS. 5A and 5B, "speech fdlp" indicates a result obtained when the encoding method described herein is applied, and "speech raw" indicates a result obtained when the encoding method described herein is not applied. Referring to FIGS. 5A and 5B, it is verified that performance is consistently improved when the encoding method described herein is applied.

Figure 6A:
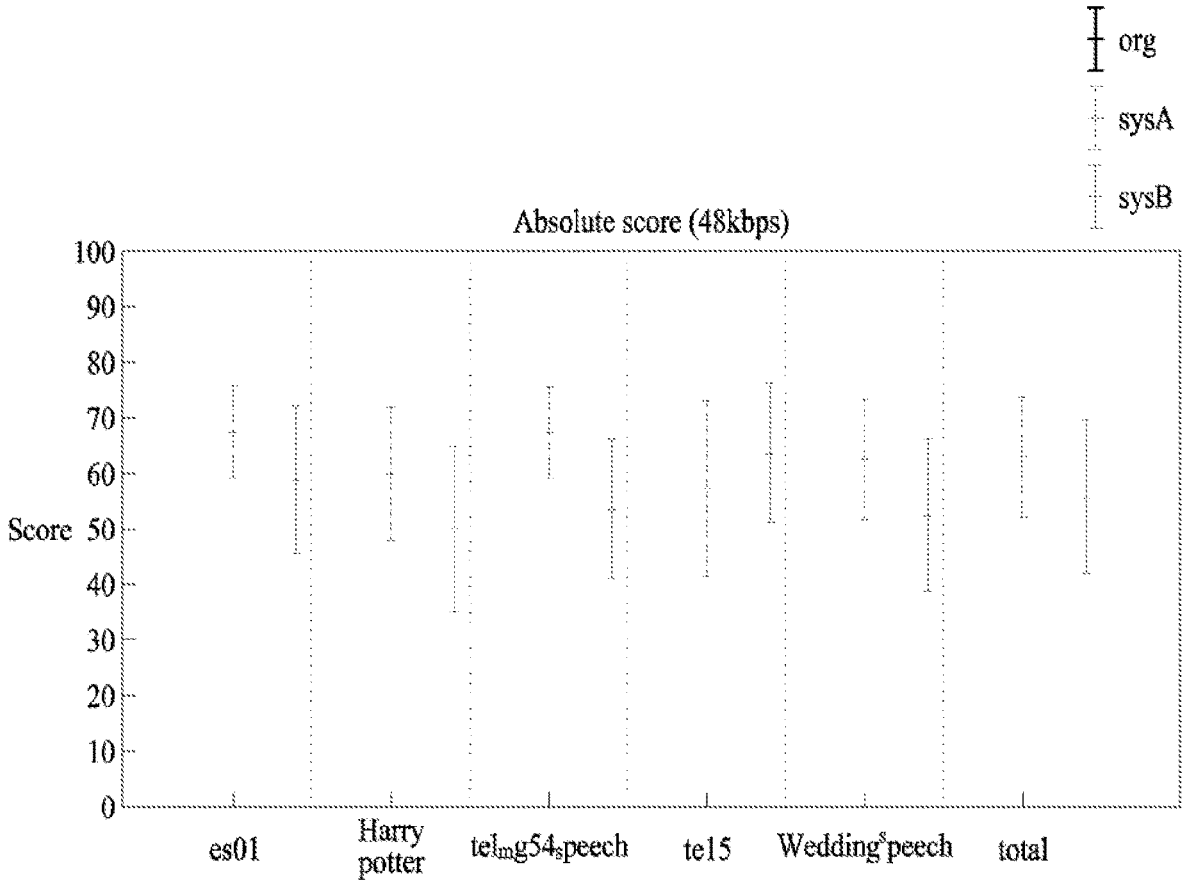
FIGS. 6A and 6B are graphs of experimental results according to an example embodiment.
Figure 6B:
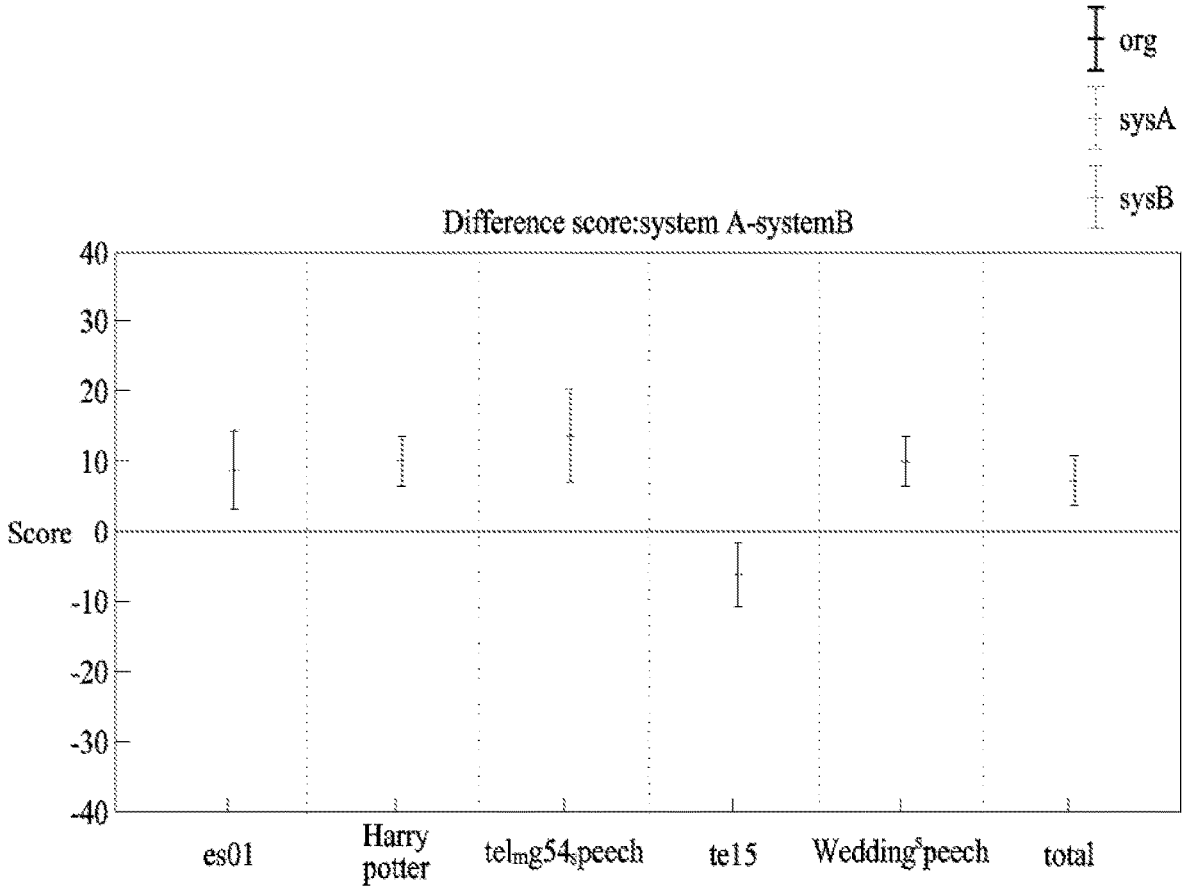

FIGS. 6A and 6B are graphs of experimental results according to an example embodiment.

The present disclosure provides a method of estimating a time-domain envelope, thereby increasing encoding efficiency. FIGS. 6A and 6B are diagrams illustrating experimental results obtained by subjectively comparing encoding and decoding results obtained when the provided method is applied and when the provided method is not applied.

FIG. 6A is a graph obtained by comparing absolute scores of results obtained when the provided method is applied and when the provided method is not applied, in terms of a sound quality of a decoded audio signal. In FIG. 6A, "sysA" indicates a result obtained when the provided method is applied, and "sysB" indicates a result obtained when the provided method is not applied. FIG. 6A shows results of experiments performed on a plurality of different items, for example, es01, Harry Portter, and the like.

Referring to FIG. 6A, when a sound quality is subjectively evaluated, it is verified that the result (sysA) obtained when the provided method is applied and the result (sysB) obtained when the provided method is not applied are equal to each other in a 95% confidence interval. However, referring to FIG. 6B, it is verified that there is a significant performance improvement.

FIG. 6B is a graph obtained by comparing difference scores obtained when the provided method is applied and when the provided method is not applied, in terms of a sound quality of a decoded audio signal. In FIG. 6B, "system A" indicates a result obtained when the provided method is applied, and "system B" indicates a result obtained when the provided method is not applied. FIG. 6B shows results of experiments performed on a plurality of different items, for example, es01, Harry Portter, and the like.

Referring to FIG. 6B, it is verified that there is a significant performance improvement in terms of a difference in the final overall sound quality even in consideration of a 95% confidence interval.

The units described herein may be implemented using hardware components and software components. For example, the hardware components may include microphones, amplifiers, band-pass filters, audio to digital convertors, non-transitory computer memory and processing devices. A processing device may be implemented using one or more general-purpose or special purpose computers, such as, for example, a processor, a controller and an arithmetic logic unit (ALU), a digital signal processor, a microcomputer, a field programmable gate array (FPGA), a programmable logic unit (PLU), a microprocessor or any other device capable of responding to and executing instructions in a defined manner. The processing device may run an operating system (OS) and one or more software applications that run on the OS. The processing device also may access, store, manipulate, process, and create data in response to execution of the software. For purpose of simplicity, the description of a processing device is used as singular; however, one skilled in the art will appreciated that a processing device may include multiple processing elements and multiple types of processing elements. For example, a processing device may include multiple processors or a processor and a controller. In addition, different processing configurations are possible, such as parallel processors.

The software may include a computer program, a piece of code, an instruction, or some combination thereof, to independently or collectively instruct or configure the processing device to operate as desired. Software and data may be embodied permanently or temporarily in any type of machine, component, physical or virtual equipment, computer storage medium or device, or in a propagated signal wave capable of providing instructions or data to or being interpreted by the processing device. The software also may be distributed over network coupled computer systems so that the software is stored and executed in a distributed fashion. The software and data may be stored by one or more non-transitory computer readable recording mediums. The non-transitory computer readable recording medium may include any data storage device that can store data which can be thereafter read by a computer system or processing device.

The methods according to the above-described example embodiments may be recorded in non-transitory computer-readable media including program instructions to implement various operations of the above-described example embodiments. The media may also include, alone or in combination with the program instructions, data files, data structures, and the like. The program instructions recorded on the media may be those specially designed and constructed for the purposes of example embodiments, or they may be of the kind well-known and available to those having skill in the computer software arts. Examples of non-transitory computer-readable media include magnetic media such as hard disks, floppy disks, and magnetic tape; optical media such as CD-ROM discs, DVDs, and/or Blue-ray discs; magneto-optical media such as optical discs; and hardware devices that are specially configured to store and perform program instructions, such as read-only memory (ROM), random access memory (RAM), flash memory (e.g., USB flash drives, memory cards, memory sticks, etc.), and the like. Examples of program instructions include both machine code, such as produced by a compiler, and files containing higher level code that may be executed by the computer using an interpreter. The above-described devices may be configured to act as one or more software modules in order to perform the operations of the above-described example embodiments, or vice versa.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents.

Therefore, the scope of the disclosure is defined not by the detailed description, but by the claims and their equivalents, and all variations within the scope of the claims and their equivalents are to be construed as being included in the disclosure.

What is claimed is:

1. A method of encoding an audio signal performed by an encoder, the method comprising:

identifying a time-domain audio signal in a unit of blocks;

quantizing a linear prediction coefficient extracted from a combined block in which a current original block of the audio signal and a previous original block chronologically adjacent to the current original block are combined, using frequency-domain linear predictive coding (LPC);

generating a temporal envelope by dequantizing the quantized linear prediction coefficient;

extracting a residual signal from the combined block based on the temporal envelope;

quantizing the residual signal through one of time-domain quantization and frequency-domain quantization; and transforming the quantized residual signal and the quantized linear prediction coefficient into a bitstream, wherein the extracting a residual signal comprises:

generating a current envelope by applying symmetric windowing to a temporal envelope corresponding to the current original block and a temporal envelope corresponding to the previous original block; and extracting a time-domain residual signal from the combined block based on the current envelope.

2. The method of claim 1, wherein the quantizing the residual signal comprises:

comparing noise generated by the time-domain quantization and noise generated by the frequency-domain quantization, and quantizing the residual signal by quantization with less noise.

3. The method of claim 1, wherein the quantizing of the residual signal comprises:

comparing a signal-to-noise ratio (SNR) obtained as a result of quantizing the residual signal by the time-domain quantization and an SNR obtained as a result of quantizing the residual signal by the frequency-domain quantization, and quantizing the residual signal by quantization with a greater SNR.

4. The method of claim 1, wherein the quantizing of the residual signal comprises:

quantizing the residual signal by transforming the residual signal into a frequency domain to quantize the residual signal through the frequency-domain quantization.

5. The method of claim 1, further comprising:

generating the combined block by combining the current original block of the audio signal and the previous original block chronologically adjacent to the current original block; and transforming the combined block and a combined block obtained through a Hilbert transform into a frequency domain, and extracting linear prediction coefficients corresponding to the combined block and the Hilbert-transformed combined block by LPC.

6. A method of decoding an audio signal performed by a decoder, the method comprising:

extracting a quantized linear prediction coefficient and a quantized residual signal from a bitstream received from an encoder;

generating a temporal envelope by dequantizing the quantized linear prediction coefficient; and reconstructing an audio signal from the quantized residual signal using the temporal envelope, wherein the generating a temporal envelope comprises:

generating a current envelope by combining temporal envelopes based on linear predictive coding (LPC) coefficients corresponding to the same time from between two chronologically adjacent dequantized LPC coefficients.

7. The method of claim 6, when the quantized residual signal is quantized in a frequency domain, further comprising:

dequantizing the quantized residual signal and transforming the dequantized residual signal into a time domain.

8. The method of claim 6, wherein the reconstructing of the audio signal comprises:

dequantizing the quantized residual signal, and generating the audio signal from the dequantized residual signal using the current envelope.

9. The method of claim 6, when the residual signal comprised in the bitstream is quantized in the frequency domain, further comprising:

adjusting noise of the audio signal by overlapping reconstructed audio signals.

10. An encoder configured to perform a method of encoding an audio signal, the encoder comprising:

a processor, wherein the processor is configured to:

identify a time-domain audio signal in a unit of blocks;

quantize a linear prediction coefficient extracted from a combined block in which a current original block of the audio signal and a previous original block chronologically adjacent to the current original block are combined, using frequency-domain linear predictive coding (LPC);

generate a temporal envelope by dequantizing the quantized linear prediction coefficient;

extract a residual signal from the combined block based on the temporal envelope;

quantize the residual signal using one of time-domain quantization and frequency-domain quantization; and transform the quantized residual signal and the quantized linear prediction coefficient into a bitstream, and wherein, in extracting the residual signal, the processor is configured to:

generate a current envelope by applying symmetric windowing to a temporal envelope corresponding to the current original block and a temporal envelope corresponding to the previous original block; and extract a time-domain residual signal from the combined block based on the current envelope.

11. The method of claim 10, wherein the processor is configured to:

compare noise generated by the time-domain quantization and noise generated by the frequency-domain quantization, and quantize the residual signal by quantization with less noise.

12. The method of claim 10, wherein the processor is configured to:

compare a signal-to-noise ratio (SNR) obtained as a result of quantizing the residual signal by the time-domain quantization and an SNR obtained as a result of quantizing the residual signal by the frequency-domain quantization, and quantize the residual signal by quantization with a greater SNR.

13. The method of claim 10, wherein the processor is configured to:

when the residual signal is quantized in a frequency domain, quantize the residual signal by transforming the residual signal into the frequency domain.

14. The method of claim 10, wherein the processor is configured to:

generate the combined signal by combining the current original block of the audio signal and the previous original block chronologically adjacent to the current original block; and transform the combined block and a combined block obtained through a Hilbert transform into a frequency domain and extract linear prediction coefficients corresponding to the combined block and the Hilbert-transformed combined block by LPC.

* * * * *